US005815838A

United States Patent [19]

Lord et al.

[11] Patent Number: 5,815,838

[45] Date of Patent: Oct. 6, 1998

[54] SPORTS GLOVE

[75] Inventors: Timothy Leon Lord, Manchester, Tenn.; Floyd Jackson Hayes, Jr., Milford, Va.

[73] Assignee: Worth, Inc., Tullahoma, Tenn.

[21] Appl. No.: 815,625

[22] Filed: Mar. 13, 1997

[51] Int. Cl.[6] ..... A41D 19/00

[52] U.S. Cl. ..... 2/161.1; 2/19

[58] Field of Search ..... 2/19, 20, 159, 2/160, 161.1, 161.2

[56] References Cited

U.S. PATENT DOCUMENTS

| | | | |
|---|---|---|---|
| D. 324,435 | 3/1992 | Jeronimo, Jr. . | |
| D. 327,754 | 7/1992 | Hochgesang et al. . | |
| D. 328,369 | 7/1992 | Hong . | |
| 3,606,614 | 9/1971 | Dimitroff . | |
| 4,006,900 | 2/1977 | DiVito | 2/19 X |
| 4,187,557 | 2/1980 | Tombari . | |
| 4,371,984 | 2/1983 | Fowler | 2/20 X |
| 4,624,016 | 11/1986 | Luevano . | |
| 4,691,387 | 9/1987 | Lopez . | |
| 4,700,405 | 10/1987 | Sternberg . | |
| 4,754,499 | 7/1988 | Pirie . | |
| 4,864,660 | 9/1989 | Sawyer . | |
| 4,977,621 | 12/1990 | Richard . | |
| 5,018,221 | 5/1991 | Romandetto | 2/20 X |
| 5,159,717 | 11/1992 | Drew et al. | 2/20 |
| 5,180,165 | 1/1993 | Frost . | |
| 5,184,815 | 2/1993 | Maddox . | |
| 5,218,719 | 6/1993 | Johnson . | |
| 5,322,286 | 6/1994 | Frost | 2/20 X |
| 5,471,682 | 12/1995 | Robins et al. . | |
| 5,588,651 | 12/1996 | Frost | 2/20 X |

*Primary Examiner*—C. D. Crowder
*Assistant Examiner*—Shirra L. Jenkins
*Attorney, Agent, or Firm*—Waddey & Patterson; Mark J. Patterson

[57] ABSTRACT

A batting glove is designed for players that hold the bat with one or two fingers over or under the knob. The glove includes a knob receptacle that will act as a pivot point for the knob in the palm of the glove. A surface pad is fixed proximally along the surface of the palm of the glove. A piece of foam is mounted proximally perpendicularly to the surface pad approximating the shape of the letter "J". A cover is then placed over both foam pads to protect the pads against wear.

1 Claim, 3 Drawing Sheets

SPORTS GLOVE

BACKGROUND OF THE INVENTION

The present invention relates generally to sports device and more particularly to a batting glove.

Baseball and especially softball hitters have created several different batting styles to maximize comfort and bat performance. The "traditional" batting style consists of placing both hands above the knob of the bat or taking this style to an extreme by choking up on the bat (sliding the hands up away from the knob and closer to the taper area of the bat). However, the majority of upper level softball players and some baseball players have adopted a "non-traditional" batting style that increases the radius of rotation of the bat; thus increasing bat speed, leverage and power.

For the non-traditional batting styles, players place the knob in two different locations in the palm of the hand. First, a player will place the knob in the palm approximately parallel with the pinky finger. The fingers will wrap around the knob with the pinky finger either over or under the knob. This represents the largest group in the higher echelon players in softball.

Secondly, a smaller segment of the softball players will place two fingers under the knob and the knob will rest centered in the palm, parallel between the ring and the pointer finger. This segment is found predominantly in the A and B league players and is much small than the number of players who place one finger over or under the end of the knob.

As can be seen in FIG. 1, the traditional grip allows a radius of about 29.5 inches. However, using the same bat, with the same weight, the user attains a radius of 31.5 inches. Although the additional two inches does not seem significant, the additional moment arm created by the extended radius is five to ten percent greater. Therefore, the force exerted by the tip of the bat becomes five to ten percent greater.

The major complaint from hitters using the non-traditional batting style is that the batting gloves are not adequately designed for comfort and durability for players using the non-traditional batting style. Holding a knob of a bat is much more uncomfortable and tends to wear the hand much more.

Several baseball players utilize these batting styles as well. Players either hold the bat in a traditional way with the palms on the handle and the knob below the hands or a non-traditional way with the palm placed over the end of the bat with one or more fingers over or under the knob.

Various types of batting gloves have been developed. These are described in U.S. Pat. Nos. 5,180,165; 5,184,815;4,977,621; 4,864,660; 4,700,405; 4,187,557; 5,471,682; 5,218,719; 4,754,499; 4,691,387; 4,624,016;3,606,614; Des. No. 327,754; and Des. No. 324,435. However, many of these devices recognize a batter's desire to use the "traditional" grip. None recognize the problems associated with grabbing the knob of a bat with the hand.

What is needed, then, is a sports glove that comforts and protects the hand of a user using the non-traditional grip. This need glove must take into account the additional forces placed upon the hand by the knob of the bat. This needed system must allow the user of a non-traditional grip to better grasp the knob of a bat. This device is presently lacking in the prior art.

SUMMARY OF THE INVENTION

The glove of the present invention is designed for the players that hold the bat with one or two fingers over or under the knob. The glove is designed to be a knob receptacle that will act as a pivot point for the knob in the palm of the glove. A standard glove is provided with a pad lying proximally along the surface of the glove of the palm. A piece of foam is the mounted proximally perpendicularly to the surface pad approximating the shape of the letter "J". A cover is then placed over both foam pads to protect the pads against wear.

The foam attachment to the glove of the present invention is designed to act as a knob receptacle.

One object of the present invention is to provide a glove having a multi-layer receptacle which not only increases comfort, but also adds life to the batting glove by adding protection to the wear areas created by the knob rubbing against the palm of the batting glove.

Another object of the present invention is to provide a glove designed specifically as a knob receptacle and pivot point for the bat in the palm of the hand that maximizes the radius of rotation of the bat and increases comfort and durability of the batting glove.

Another object of the glove of the present invention is to provide a glove usable by a large number of hitters. The chart below shows players by classification (A—higher skill level players, D—lower skill level players) and their preferred grip.

BRIEF DESCRIION OF THE DRAWINGS

Figure 7A:
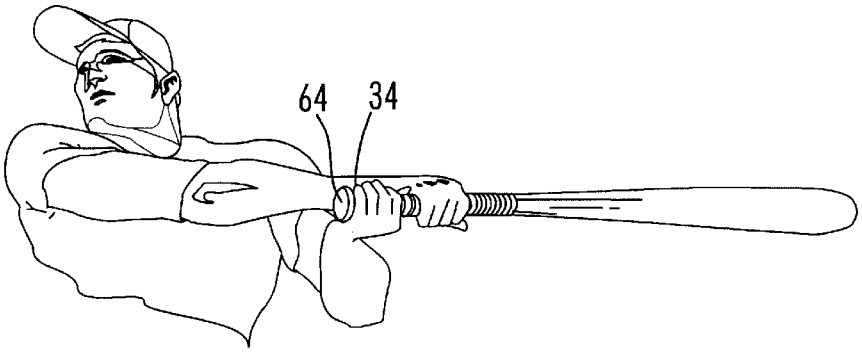

FIG. 7*a* shows a batter holding a bat with a conventional grip.

Figure 7B:
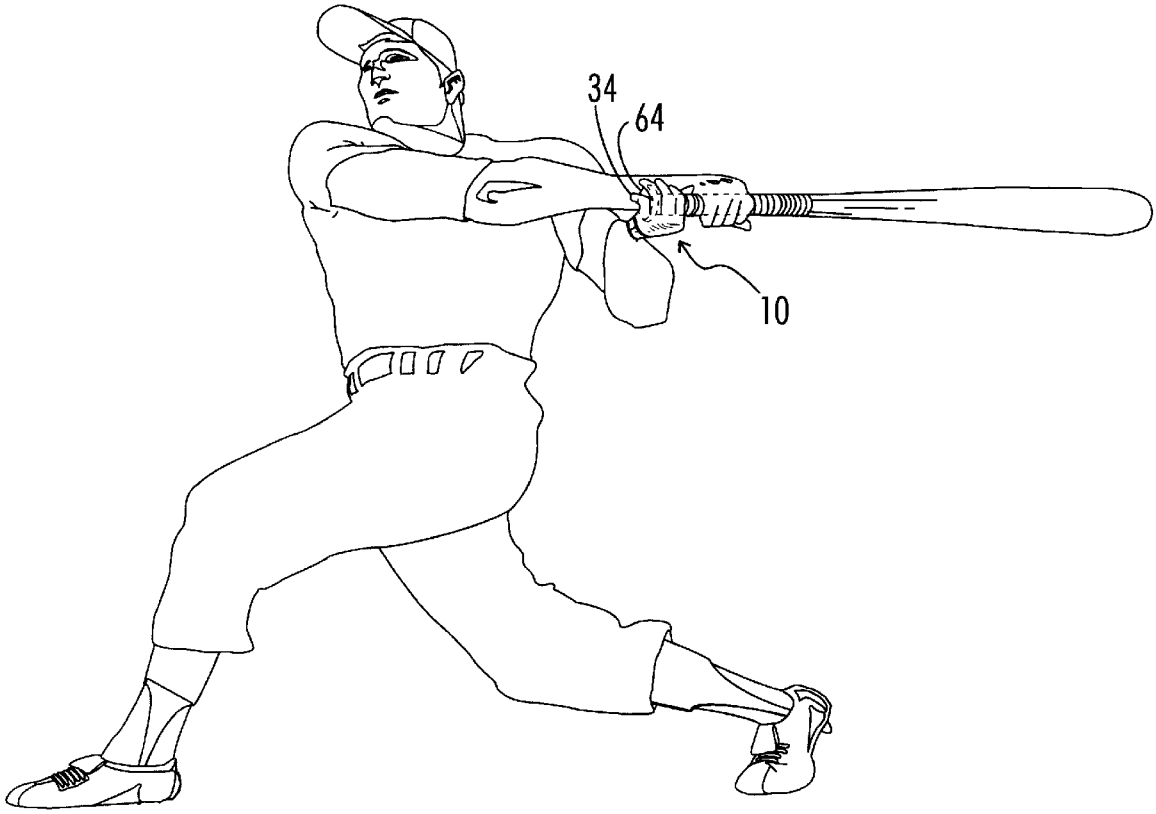

FIG. 7*b* shows a user holding a bat in a power lock grip.

DESCRIPTION OF THE PREFERRED EMBODIMENT

The preferred embodiment of the invention will be best understood when considered in connection with the drawings, including FIGS. 1, 2, 3, 4, 5, and 6.

Referring now to the drawings, there is shown generally at 10, the glove of the present invention. Like most other gloves, glove 10 has hand cover feature 12 generally having palm portion 14 from which finger portions 27 (thumb portions 38, index finger portion 28, middle finger portion 30, ring finger portion 32, and small finger portion 34) extend. Opposite finger portions 27, there lies opening 36 into which user places his or her hand. Cover portion 12 also has upper edge 22 proximal thumb portion 38 and lower edge 24 proximal small finger portion 34. Between upper edge 22 and lower edge 24 and between middle finger portion 30 and ring finger portion 32 there lies center line 26.

In the preferred embodiment, glove 10 has cradle portion 40 which receives knob 64 of bat 60. Preferably, cradle portion 40 has surface pad or bottom layer 16 mounted proximally flush along palm portion 14. Mounted substantially perpendicular to surface pad 16 or to palm portion 14 is extending pad or top layer 18 which is preferably a pad in the shape of a "J" or J pad. J pad partially encircles knob 64. Material cover 20 can be provided to protect surface pad 16 and J pad 18 from wear caused by knob 64.

Preferably, bottom layer 16 is a soft foam, 3/16" MLC from Ensolite Co., designed to cushion the knob as it rests against the palm of the hand. Preferably, top layer 18 is shaped like a "J" and is made of a more rigid foam, 1'8" IV3 from Ensolite Co., Mishawaka, Ind. The purpose of J pad 18 is to encapsulate knob 64 and to provide a ridge for knob 64 to rest. The "J" shape was selected because it contours the shape of knob 64 and creates knob receptacle or cradle portion 40. Material cover 20 will cover pads 16, 18 and will be constructed to last longer than traditional leather batting gloves.

Figure 6:
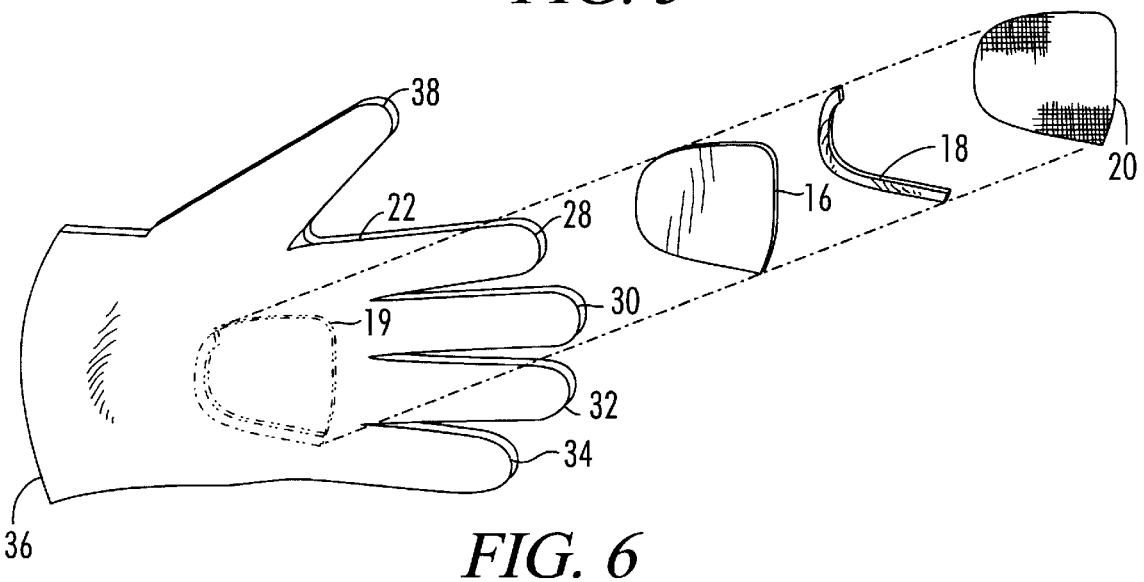
FIG. 6 is an exploded view of the assembly of the glove of the present invention.

During assembly, preferably, surface pad 16 and extending pad 18 will be tacked together at both ends with a sewing machine to form combined pad 19. Combined pad 19 will then be tacked on to palm portion 14 of hand cover 12 as shown in FIG. 6. Cover material will then be stretched and sewn over the combined pad 19.

ELECTRICAL AND THEORETICAL EVALUATION OF APPLICANT's INVENTION

Figure 1:
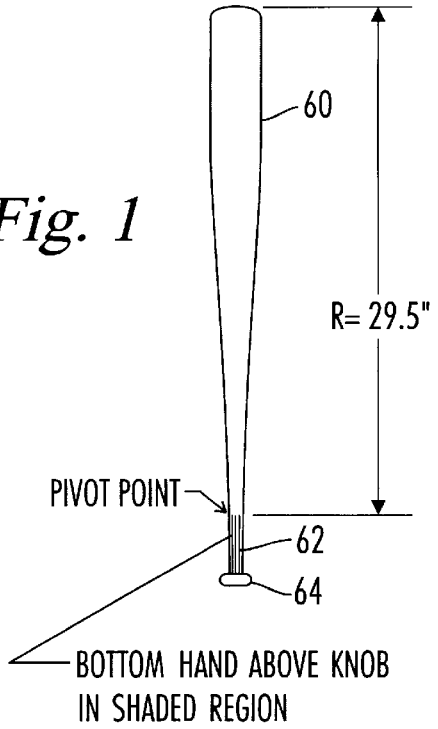
FIG. 1 is frontal view of the traditional grip with hands above the knob resulting in a 29.5" radius of rotation.
Figure 2:
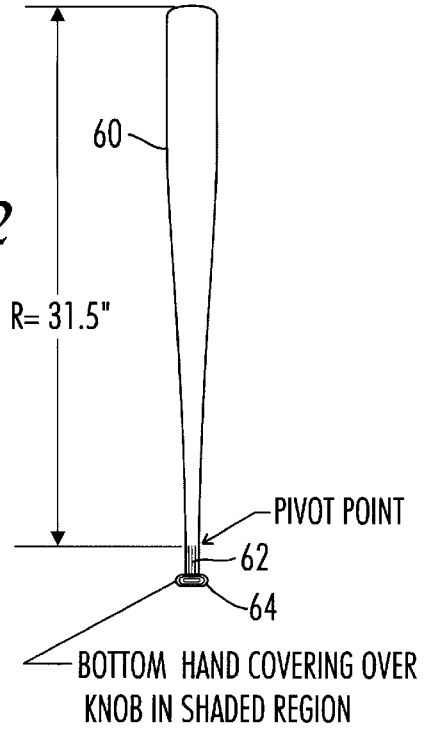
FIG. 2 is a frontal view of the power lock grip with hands over the knob resulting in a 31.5" radius of rotation.
Figure 3:
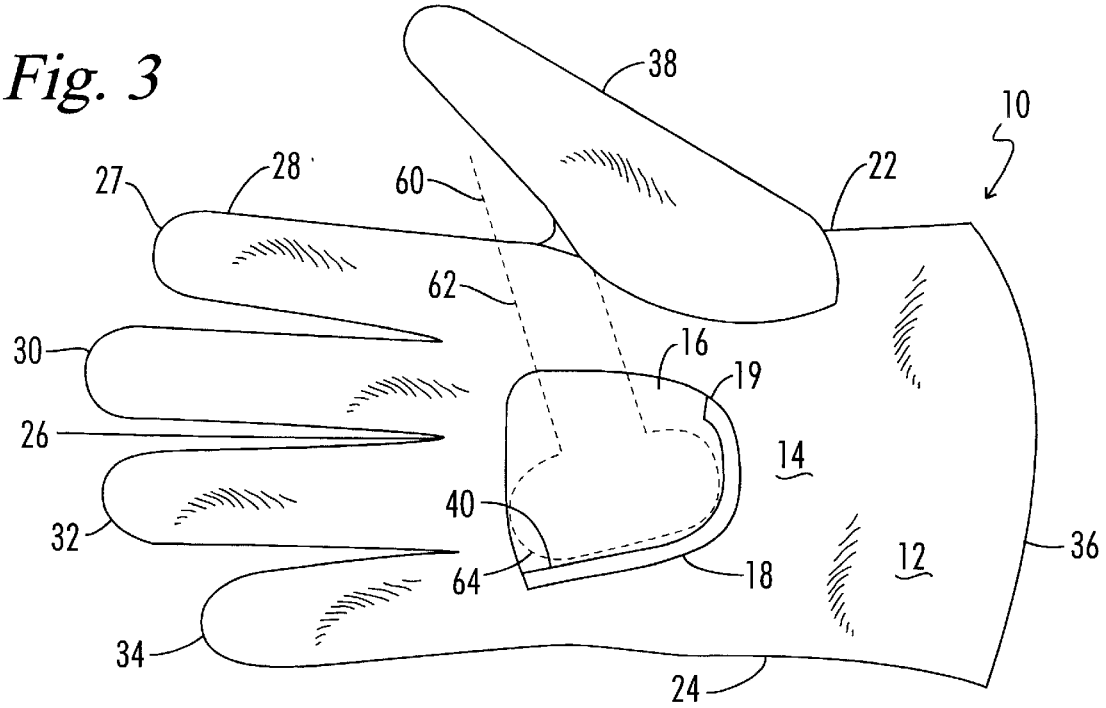
FIG. 3 is a plan view of the glove of the present invention.

As shown by FIGS. 1 and 2, a conservative estimation of the radius of rotation for a 34" bat is shown in the table below.

| Batting Style | Radius of Rotation |
|---|---|
| Traditional | 29.5" |
| Power Lock | 31.5" |
| Difference | 2.0" |

In theoretical terms, the equation below can be used to unlock the performance advantage of the Power Lock batting glove. During the swing, the radius of rotation is continuously changing. However at impact, the radius of rotation of a bat is the distance from the pivot point created by the bottom hand on the bat to the end of the bat.

$$V = R * \omega$$

$V$ = Linear Bat Speed Upon Impact with Ball
$R$ = Radius of Rotation
$\omega$ = Angular speed of the bat Assuming that the angular speed remains constant, then the linear bat speed is directly proportional to the radius of rotation. Since the Power Lock lengthens the radius of rotation by at least 2", the players bat speed increases resulting in a substantial increase in energy transfer upon impact collision. The linear bat speed is increased by 7%.

The 7% increase in bat speed does not include any increase in bat speed due to the gains in comfort due to the three layers of padding and fabric. In addition, it does not include any increase in speed due to the Power Lock acting as an improved free-swinging pivot point due to the intent of the knob receptacle.

Figure 4:
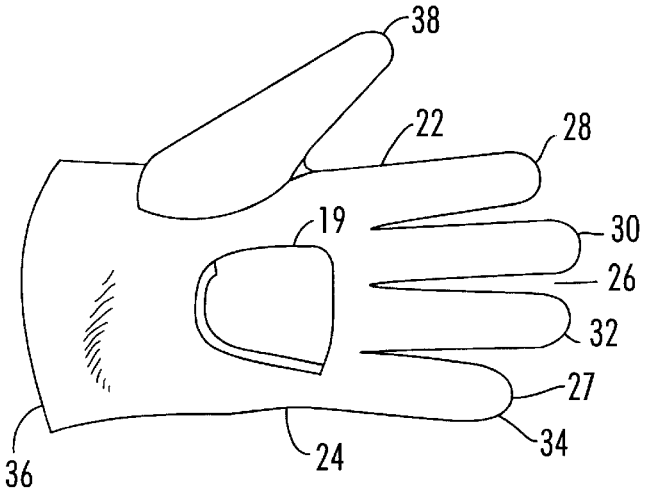
FIG. 4 is a plan view of the glove of the present invention for one non-traditional grip wherein a player that holds 1 finger over or under the end of the knob.
Figure 5:
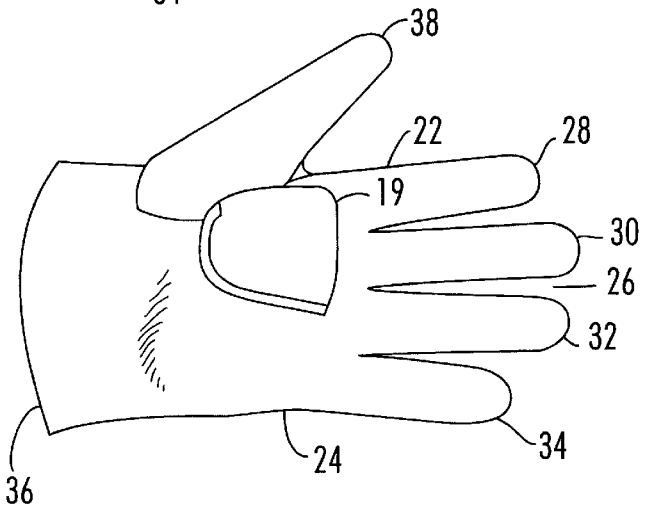
FIG. 5 is a plan view of another embodiment of the glove of the present invention wherein the pad shifted up to accommodate the players that hold the bat with two fingers over the knob.

Referring now to FIGS. 4 and 5, one can see two embodiments of the glove 10 of the present invention. In FIG. 4, combined pad 19 and material cover 20 are mounted generally around center line 26 of glove 10. This embodiment with be preferable to the non-traditional grip keeping the small finger portion 34 below knob (64 in FIG. 3).

In FIG. 5, combined pad 19 and material cover 20 are mounted generally closer toward upper edge 22 and higher in relation to center line 26 of glove 10. This embodiment with be preferable to the non-traditional grip keeping the small finger portion 34 and ring finger portion 32 below knob (64 in FIG. 3).

Referring now to FIG. 7*a*, there is shown a user holding a bat using a traditional grip. As can be seen, pinkie finger 34 rests upon bat above knob 64.

Referring now to FIG. 7*b*, there is shown the modified grip of the present invention. As can be seen, pinkie 34 rests off of bat below knob 64. Left hand is shown assisting user.

Thus, although there have been described particular embodiments of the present invention of a new and useful sports glove, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A glove for receiving a knob of a bat, said glove having a hand cover having a palm portion, said glove comprising:

a. a surface pad attached to said palm portion;

b. a J pad mounted to said surface pad; and c. a cover material attached to said palm portion and covering said surface pad and said J pad.

* * * * *